US009199697B2

(12) United States Patent
Dang

(10) Patent No.: US 9,199,697 B2
(45) Date of Patent: Dec. 1, 2015

(54) DUAL AXIS CHAIN SUPPORT WITH CHAIN GUIDE

(71) Applicant: SOFEC, INC., Houston, TX (US)

(72) Inventor: Quoc Anh Dang, Cypress, TX (US)

(73) Assignee: SOFEC, Inc., Houston, TX (US)

( * ) Notice: Subject to any disclaimer, the term of this patent is extended or adjusted under 35 U.S.C. 154(b) by 114 days.

(21) Appl. No.: 14/044,664

(22) Filed: Oct. 2, 2013

(65) Prior Publication Data

US 2015/0090171 A1 Apr. 2, 2015

(51) Int. Cl.

| | |
|---|---|
| ***B63B 21/50*** | (2006.01) |
| ***B63B 21/20*** | (2006.01) |
| ***B63B 21/04*** | (2006.01) |
| ***B63B 21/18*** | (2006.01) |
| ***B63B 21/10*** | (2006.01) |

(52) U.S. Cl.

CPC ..... *B63B 21/20* (2013.01); *B63B 21/04* (2013.01); *B63B 21/10* (2013.01); *B63B 21/18* (2013.01); *B63B 21/50* (2013.01); *B63B 2021/203* (2013.01)

(58) Field of Classification Search

CPC ..... B63B 21/50; B63B 21/04; B63B 21/22; B63B 22/04; B63B 21/20; B63B 21/10; B63B 21/18; B63B 2021/203

USPC ..... 114/230.2, 230.28, 230.29; 405/224, 405/224.2

See application file for complete search history.

(56) References Cited

U.S. PATENT DOCUMENTS

| | | | | |
|---|---|---|---|---|
| 3,289,626 | A | 12/1966 | Petrie | |
| 3,557,737 | A | 1/1971 | Smulders | |
| 4,129,270 | A * | 12/1978 | Robinson et al. | 244/135 A |
| 4,318,522 | A * | 3/1982 | Appleberry | 248/179.1 |
| 4,813,815 | A * | 3/1989 | McGehee | 405/202 |
| 5,193,872 | A | 3/1993 | Fujita | |
| 5,441,008 | A | 8/1995 | Lange | |
| 5,842,434 | A | 12/1998 | Lange et al. | |
| 5,845,893 | A | 12/1998 | Groves | |
| 6,435,121 | B2 | 8/2002 | Siring | |
| 6,439,146 | B2 | 8/2002 | Seaman | |
| 6,663,320 | B1 | 12/2003 | Braud | |
| 7,104,214 | B2 | 9/2006 | Niebur | |
| 7,325,508 | B2 | 2/2008 | Boatman et al. | |
| 7,392,757 | B2 | 7/2008 | Niebur | |
| 7,926,436 | B2 | 4/2011 | Boatman et al. | |
| 2006/0213418 | A1 | 9/2006 | Boatman et al. | |
| 2010/0175604 | A1 | 7/2010 | Boatman et al. | |
| 2013/0223937 | A1 * | 8/2013 | Lajugie et al. | 405/224.2 |

FOREIGN PATENT DOCUMENTS

GB 2351085 A 12/2000

OTHER PUBLICATIONS

PCT Search Report and Written Opinion (PCT/US2014/058069), dated Dec. 31, 2014.

* cited by examiner

*Primary Examiner* — Anthony Wiest
(74) *Attorney, Agent, or Firm* — Douglas W. Rommelmann; Andrews Kurth LLP

(57) ABSTRACT

A chain support, hinged on two perpendicular axes to allow chain movement in two perpendicular planes is disclosed. The apparatus provides an improved arrangement to allow chain to be pulled at an angle above the chain support while maintaining straight pull across a stopper mechanism.

6 Claims, 10 Drawing Sheets

DUAL AXIS CHAIN SUPPORT WITH CHAIN GUIDE

BACKGROUND OF THE INVENTION

1. Field of the Invention

This invention relates generally to mooring systems for offshore structures such as platforms and vessels and in particular, to a device which supports the mooring chain in such systems.

2. Description of the Prior Art

FIG. 1 illustrates a prior art mooring line connector from U.S. Pat. No. 6,663,320 (published Dec. 16, 2003). The known connector allows the mooring line to rotate in two perpendicular planes relative to the offshore structure to which it is attached. The mooring line is connected using a rod and a latch mechanism. Adjustment of the length of the mooring line, which is often desired before and sometimes after installation of the mooring line, will have to take place before the rod is connected, most likely on board of another vessel.

FIG. 2 illustrates a prior art mooring line connector from UK Patent Application GB2351058 (published Dec. 12, 2000). This chain stopper provides two axes of rotation, and as a result reduced chain wear, but the construction is not designed to minimize so called out-of-plane bending, which occurs when the chain is under tension and one chain link (the captive link) is fixed by the chain stopper while the adjacent link below the captive link is allowed to rotate relative to the captive link. Also, during chain installation and tensioning, an uplift force is produced in the connector that must be resolved by bending the line of chain or by other means.

FIG. 3 illustrates a prior art mooring line connector from U.S. Pat. No. 7,926,436 (published Jul. 15, 2010). This chain support provides two axes of rotation, allows adjustment of the length of the mooring line and minimizes so called out-of-plane bending. The use of a trunnion block instead of a gimbal body forces the chain retainer mechanism to be located below the two axes of rotation which makes operation and maintenance of the chain retainer mechanism more challenging and requires the hawse pipe to be a load carrying member.

Identification of Objects of the Invention

A primary object of this invention is to provide a chain support in which fatigue damage due to out-of-plane bending is reduced.

Another object of this invention is to provide a chain support that allows rotation about two perpendicular axes, such that the maximum total rotation about the first axis is at least 90 degrees and the rotation about the second axis is ±15 degrees.

Another object of this invention is to provide a chain support that allows the upper end of the mooring line to be pulled up vertically through the assembly while at the same time allowing large vertical angle variations of the lower end of the assembly, without inducing objectionable vertical or lateral misalignment of the assembly with the mooring line.

Another object of this invention is to provide a chain support that allows adjustment of the mooring line length at any time by pulling in or letting out chain links with the capacity of latching into every other chain link.

Another object of this invention is to provide a chain support with an arrangement of components that minimizes the overall width of the assembly.

Another object of this invention is to provide a chain support with an integrated chain retainer guide that ensures that the chain maintains a straight line as it is pulled through the chain retainer mechanism.

Another object of this invention is to provide a chain support with an option of using either a dual chain retainer of the latch mechanism or a single chain retainer of the latch mechanism.

SUMMARY OF THE INVENTION

The objects identified above, along with other features and advantages result from providing a chain support with two axes of rotation and an elongated hawse pipe. The length of the hawse pipe is chosen such that even very small angles between the captive chain link on the chain retainer and the first free chain link below the captive link generates enough torque to rotate the hawse pipe around either one of the axes. This ensures that the bending stresses in the first free link are kept at low levels and the accrual of fatigue damage can be controlled.

An elongated hawse pipe is pivotally connected to a structure such as a vessel or buoy by using a gimbal body. The upper end of the elongated hawse pipe is fitted with one or two spring loaded chain retainers that function passively. The use of the gimbal body allows placement of the chain retainer mechanism at the upper end of the hawse pipe where it is accessible for operation and maintenance. In most existing chain support designs, the chain retainer mechanism relies on gravity to close the chain retainer. By incorporating a passive, spring actuated chain retainer mechanism, operation of the chain retainer mechanism is assured regardless of the orientation of the hawse pipe and without the need for human contact.

The chain retainer mechanism of this type provides a dual retainer of the latch mechanism. For this reason, a spring for actuation of the latch is preferred. A chain retainer with a single retainer may be provided so that a spring is not needed, such that the chain retainer relies on gravity to close.

The inside of the elongated hawse pipe is fitted with a chain guide including grooves which, when projected onto a plane that is perpendicular to the longitudinal direction of the chain, describe a cruciform. The cruciform slot aligns the chain rotationally around its longitudinal axis such that alternating links of the chain are oriented parallel or perpendicular to the chain retainer mechanism and makes possible the use of the passive chain retainer mechanism.

The gimbal body is fitted at its upper end with a chain guide which ensures that when the chain is pulled in and goes from slack to taut, the chain is pulled in a straight line across the chain retainer mechanism, even as the orientation of the hawse pipe undergoes a large change in an angle due to tensioning of the chain.

DESCRIPTION OF THE PREFERRED EMBODIMENT

Figure 1:
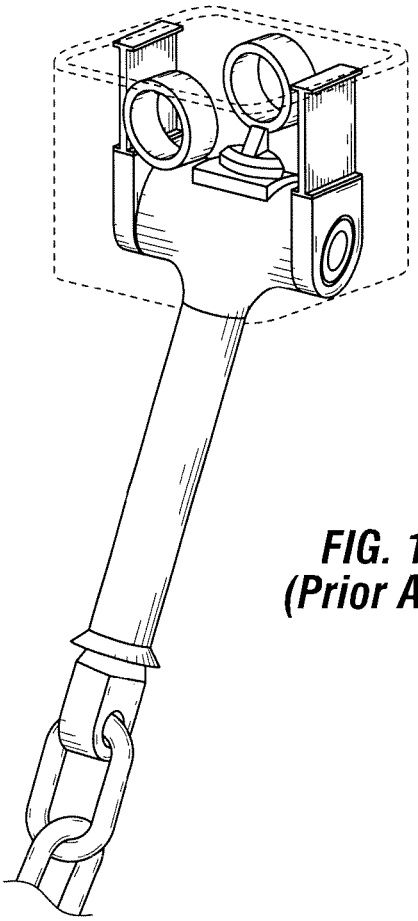
FIG. 1 (Prior Art)
FIG. 1 shows a prior art mooring line connector with two axes of rotation where the connection is established by latching a rod into a tube.
Figure 2:
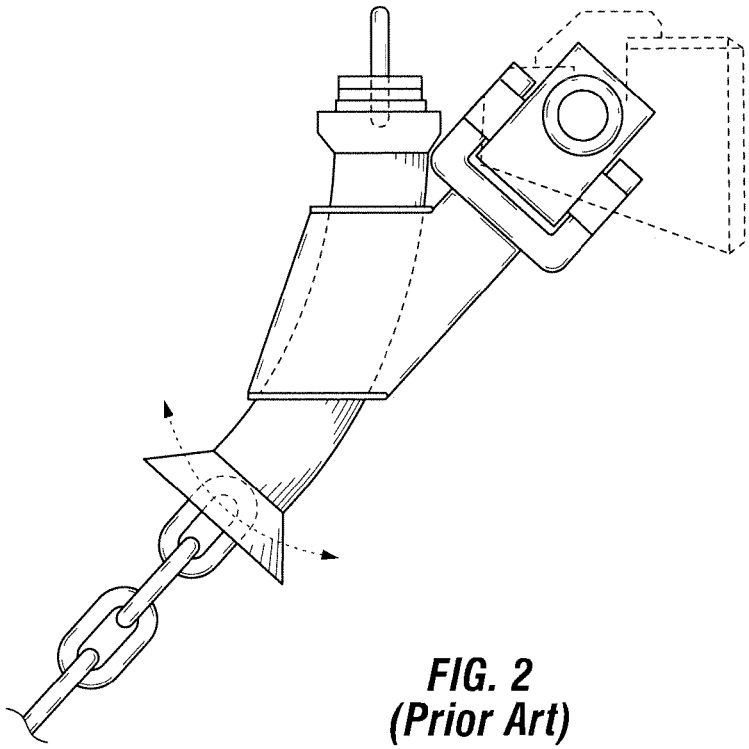
FIG. 2 (Prior Art)
FIG. 2 shows a prior art mooring line connector with two axes of rotation where the mooring line length can be adjusted by pulling up outside of the universal joint assembly.
Figure 3:
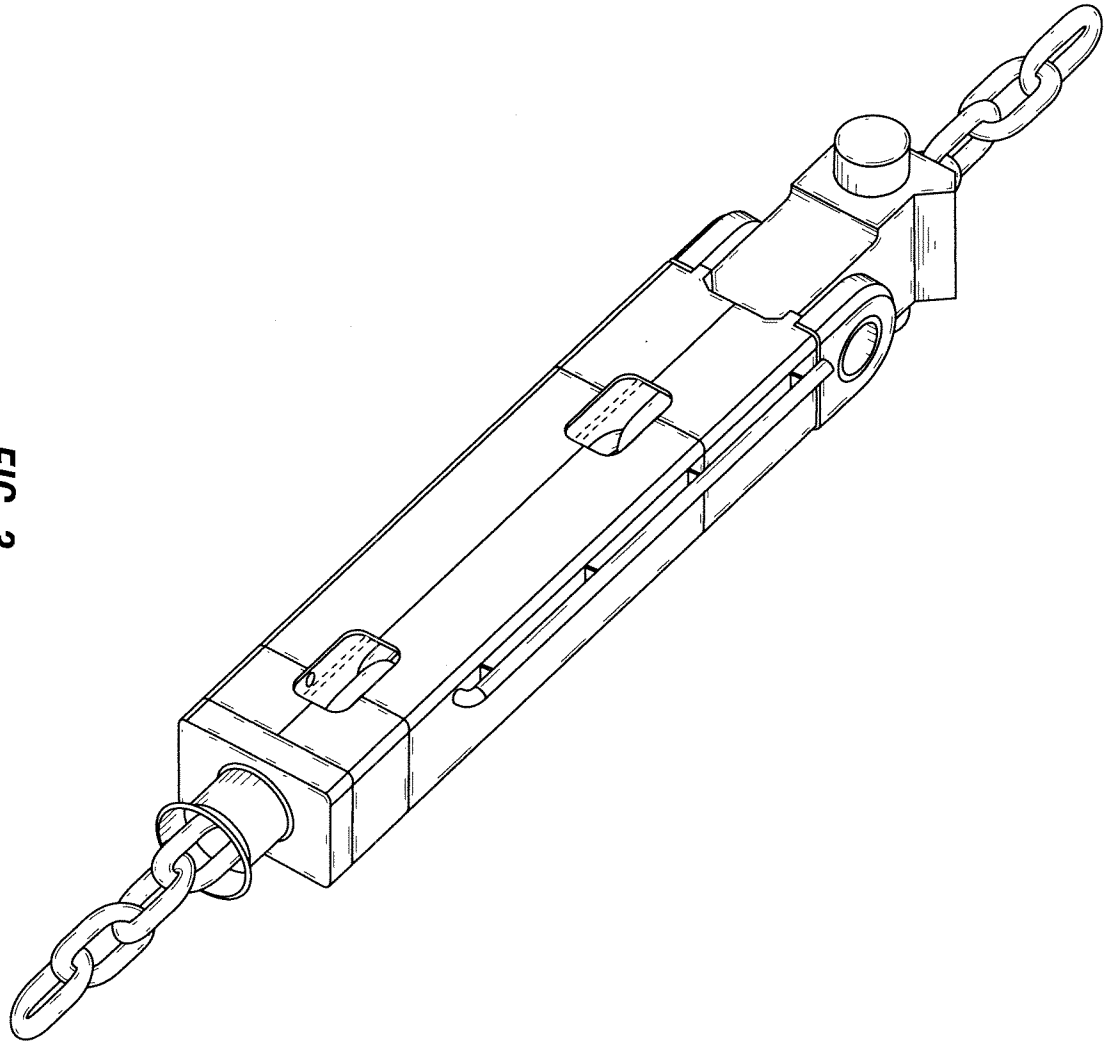
FIG. 3 (Prior Art)
FIG. 3 shows a prior art mooring line connector with two axes of rotation where the mooring line length can be adjusted by pulling the line up through a trunnion block that is fitted with two pairs of trunnions that are mutually perpendicular.
Figure 4:
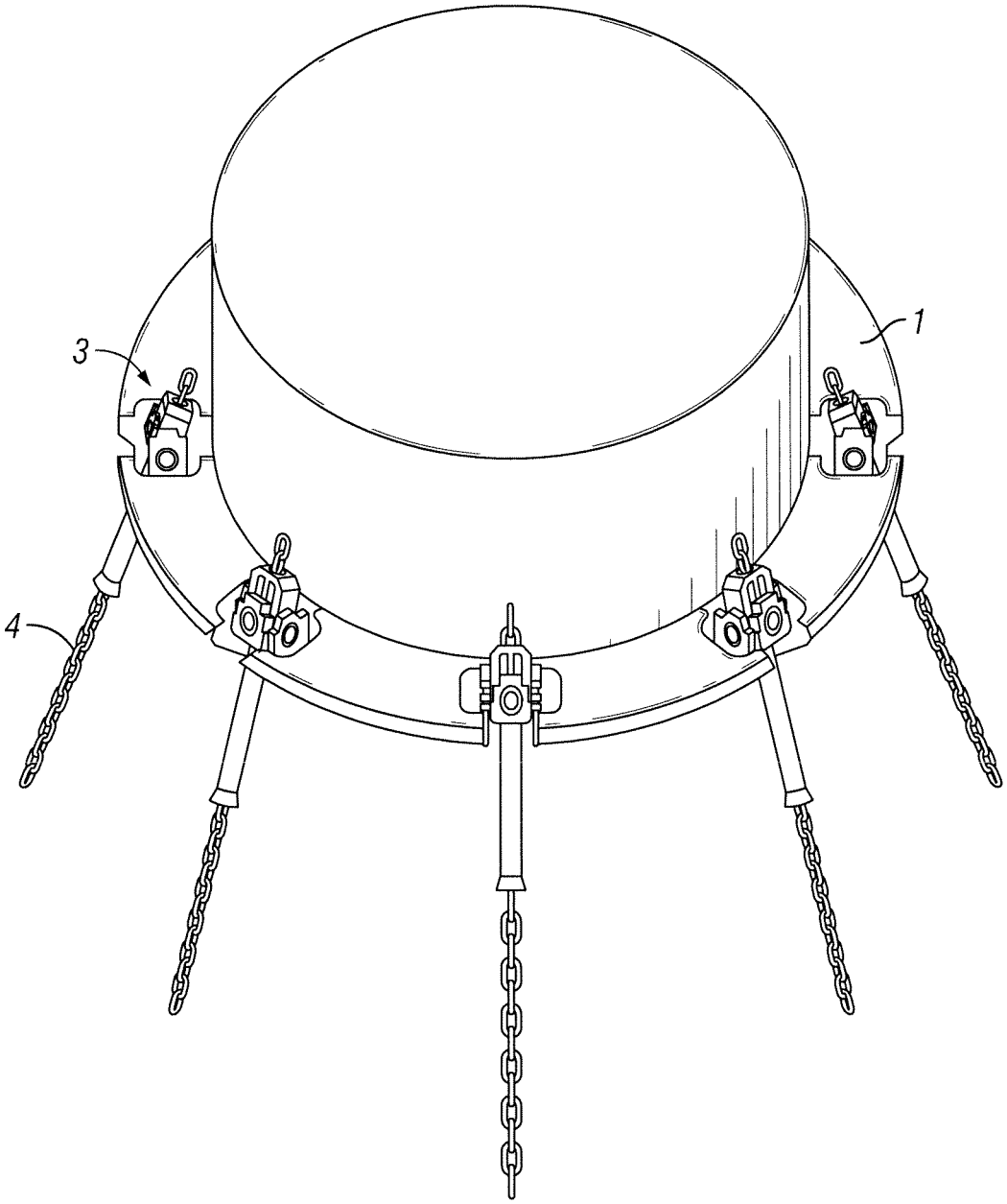
FIG. 4 shows a mooring buoy where each of the mooring lines is connected to the floating structure using the dual axis chain support/chain guide of the present invention.

FIG. 4 shows a floating structure 1 that is moored with a plurality of mooring lines. The upper end of each mooring line includes a section of chain 4 which is connected to the floating structure 1 through a chain support 3 of this invention.

Figure 5A:
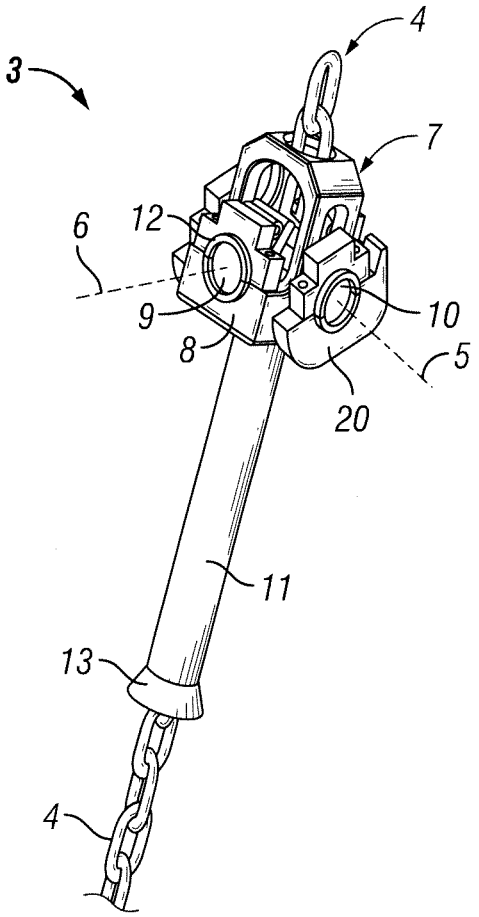
FIGS. 5*a* and 5*b* show two perspective views of the chain support of the present invention with a mooring chain extending from both ends of the chain supports, with the view of FIG. 5*b* rotated clockwise from that of FIG. 5*a;*
Figure 5B:
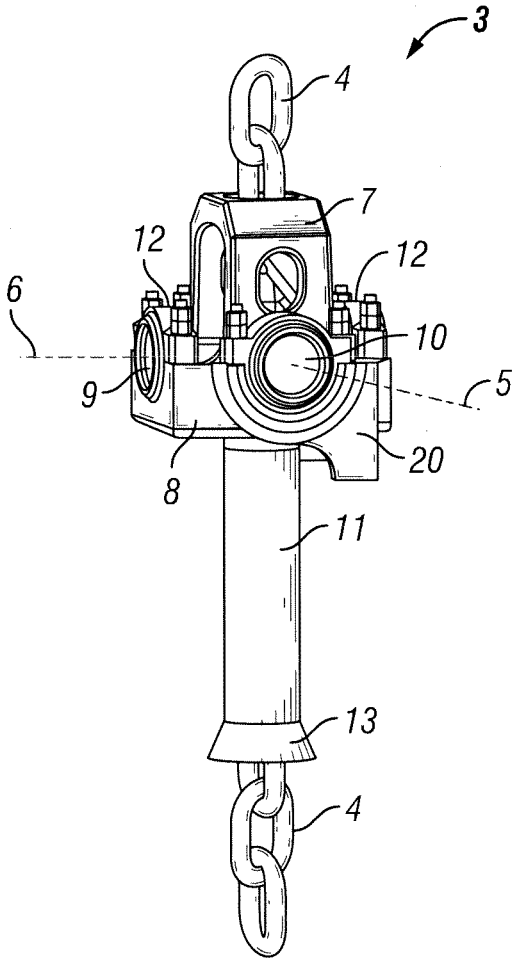

FIGS. 5*a* and 5*b* are perspective views of the chain support 3. FIG. 5*b* shows a view where the chain support 3 is rotated clockwise from the view of FIG. 5*a*. The chain support 3 allows rotation of the chain 4 around a first pivot axis 5 and a second pivot axis 6. The mooring chain 4 is pulled through guide mouth 13 and through the interior of an elongated tubular member 11. The chain 4 exits the chain support 3 through gimbal body 8.

Since the direction of pull is often different from the orientation of the tubular member 11, the gimbal body 8 is fitted with an upper chain guide 7. The gimbal body 8 is rotatably connected to the structure 1 via trunnions 10 and bearing blocks 20/bearing caps 12. See FIGS. 7*a*, 7*b*.

Figure 7B:
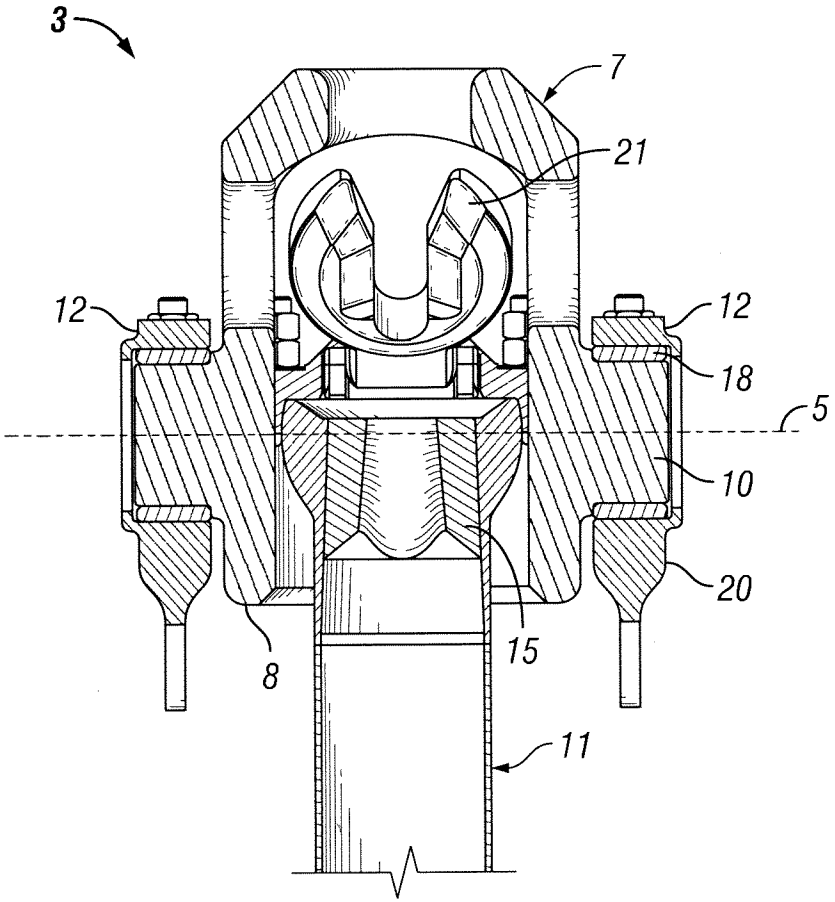
FIGS. 7*a* and 7*b* are sectional views of the chain support showing its connection to a floating structure.
Figure 7A:
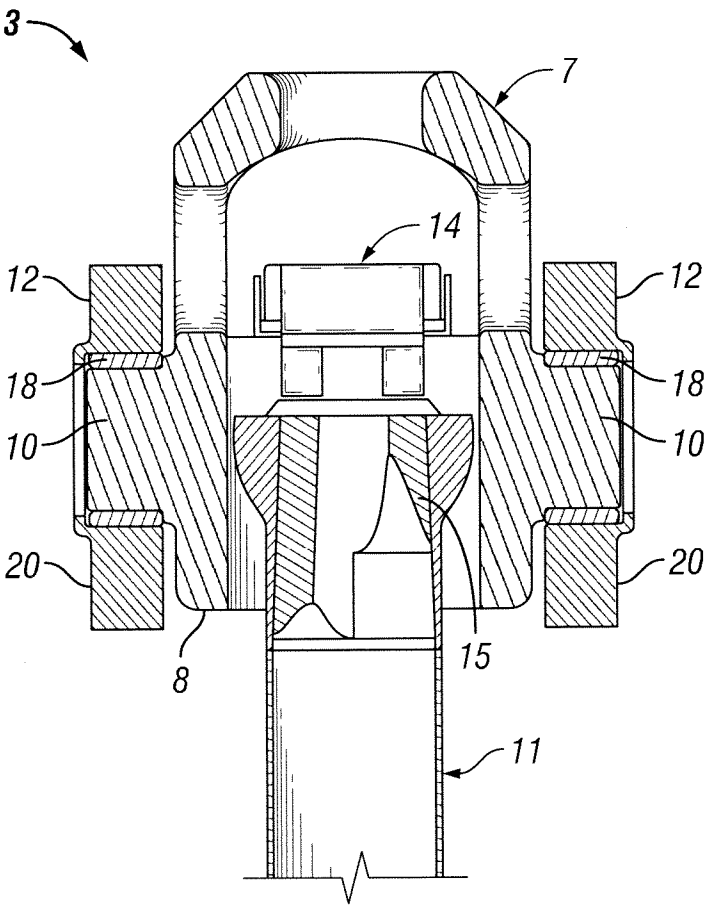
Figure 8A:
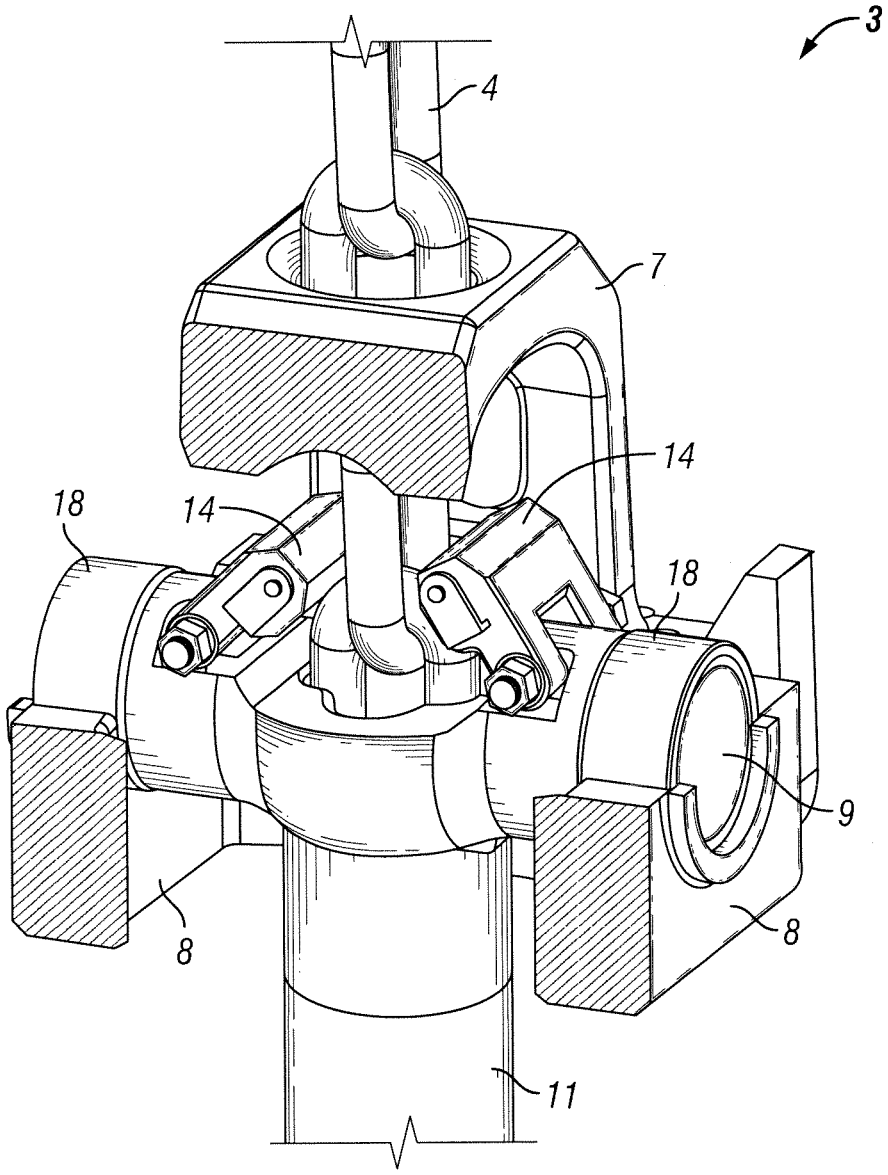
FIGS. 8*a* and 8*b* present perspective views of the chain support with the gimbal body partially removed so that chain retainers of the latch mechanism and a self-lubricating bushing between a trunnion and the gimbal body of the connection can be seen.
Figure 8B:
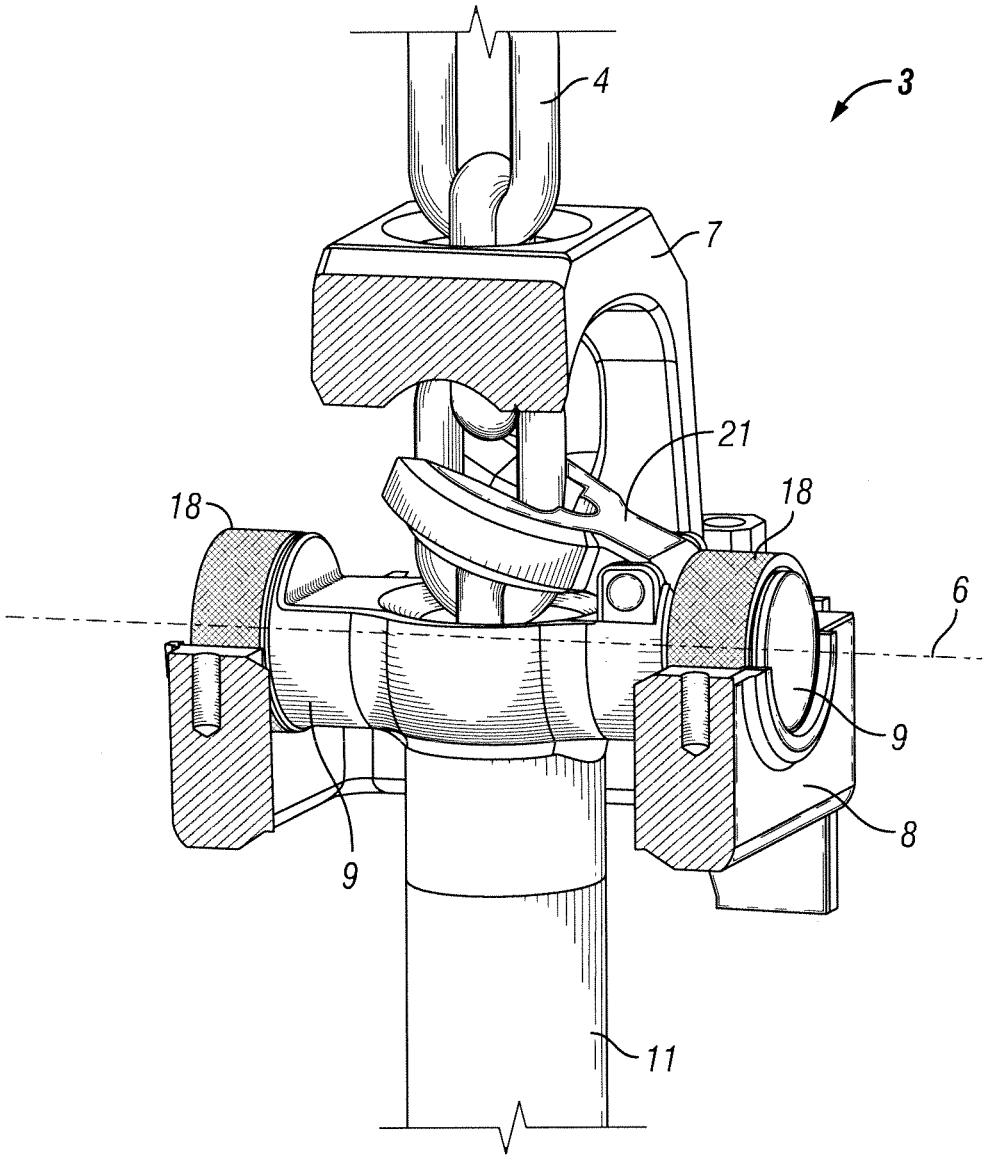

As shown in FIGS. 8*a* and 8*b*, the elongated tubular member 11 is rotatably connected to gimbal body 8 with a first pair of trunnions 9 and a bearing cap 12. FIGS. 8*a* and 8*b* show the chain support 3 with the gimbal body 8 partially "cut away" and bearing caps 12 removed so that self-lubricating bushings 18 can be seen placed between the pair of trunnions 9 and the gimbal body 8. The gimbal body 8 is secured to structure 1 (FIG. 4) as illustrated in FIGS. 7*a*, 7*b* for operation of the chain support assembly 3.

Figure 9:
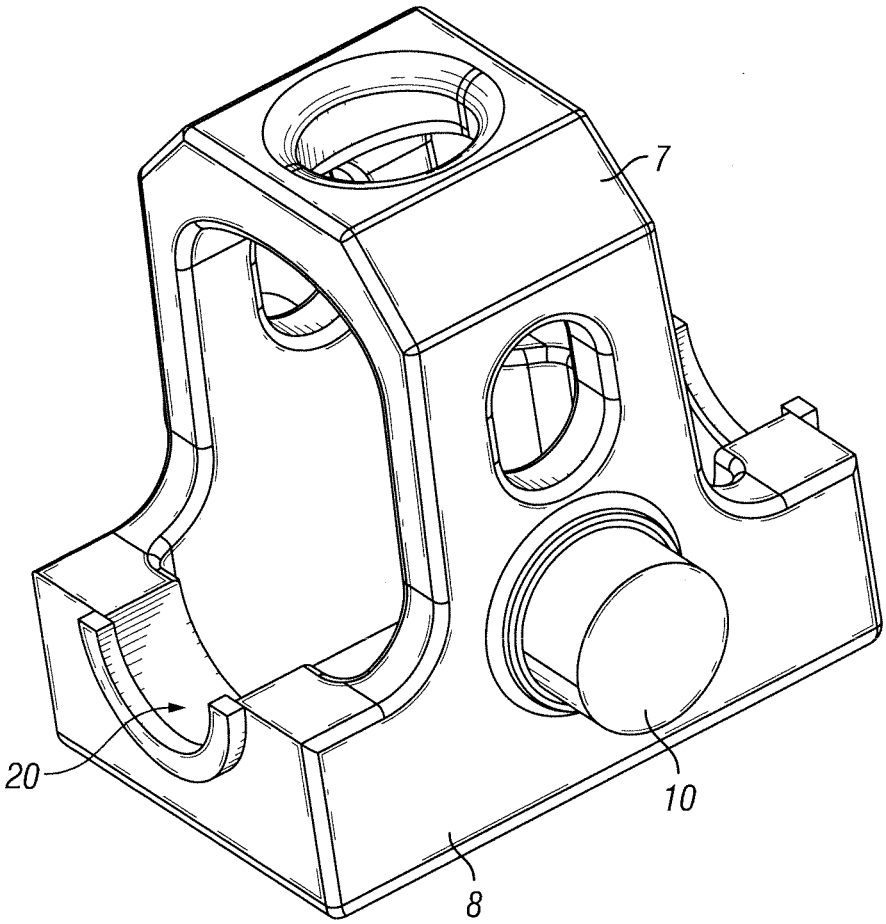
FIG. 9 is a perspective view of the gimbal body.
Figure 10B:
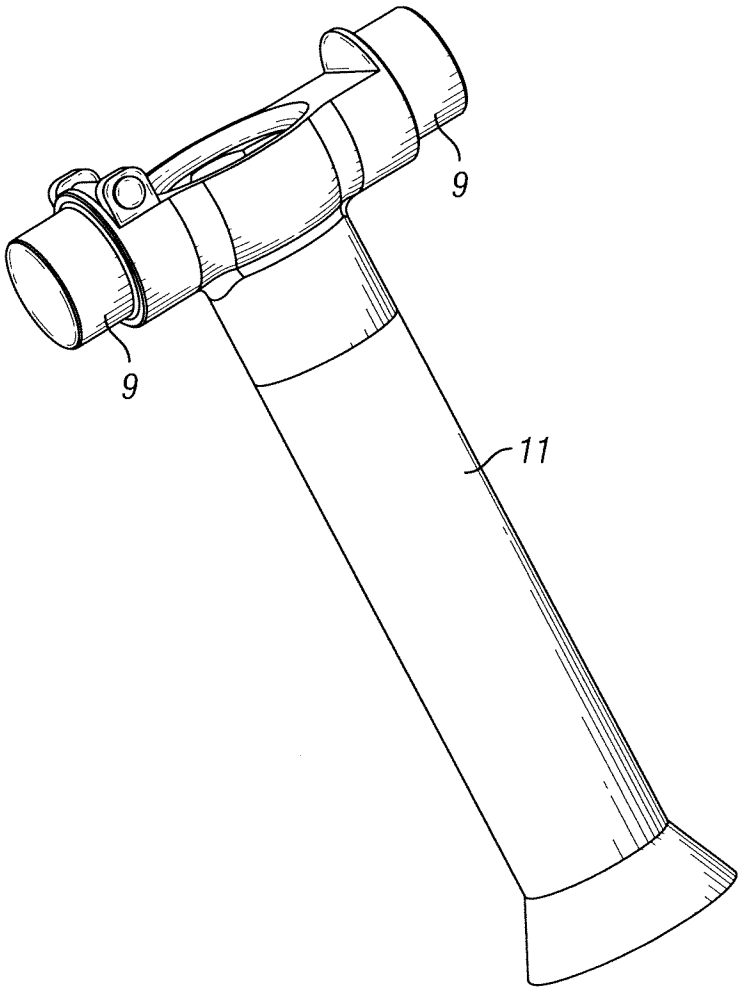
FIGS. 10*a* and 10*b* illustrate the connection of trunnions to the tubular member.
Figure 10A:
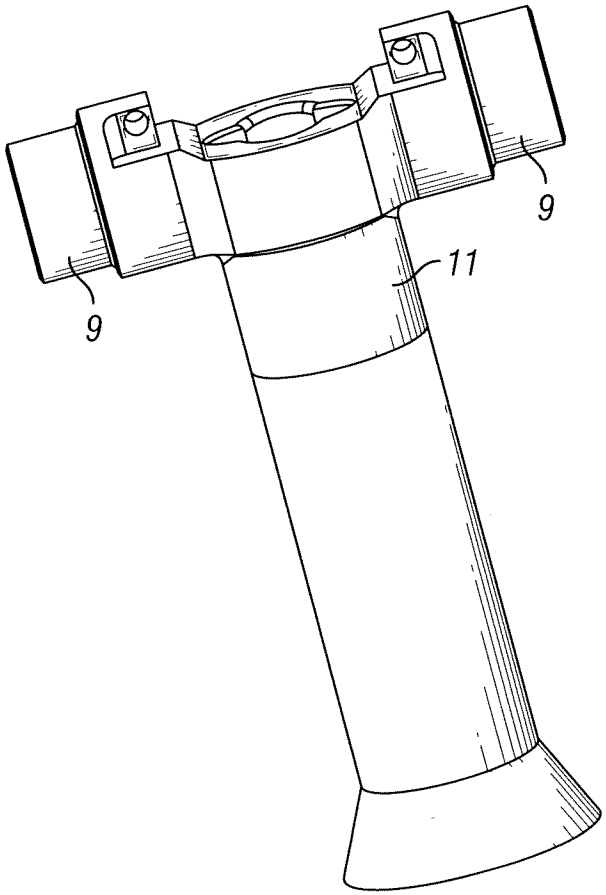

FIG. 9 illustrates the gimbal body 8 with the chain guide 7 and trunnions 10. FIGS. 10*a* and 10*b* show the trunnions 9 which are secured to tubular 11 and which are placed in the orthogonal slots 19 of the gimbal body 8. Low friction, self-lubricating bushings are also placed between the first pair of trunnions 9 and the bearing cap 12. See FIGS. 6*b*.

The first and second pair of trunnions 9, 10 are arranged to form two mutually perpendicular pivot axes 5 and 6. The second pair of trunnions 10 is pivotally connected to the structure 1 with structure bearing blocks 20 and caps 12 and low friction self-lubricating bushings 18 (FIGS. 7*a*, 7*b*) placed between the second pair of trunnions 10 and the structure bearing blocks and caps 12.

The chain 4 enters the elongated tubular member 11 through a guide mouth 13. A latch mechanism is mounted at the upper end of the elongated tubular member 11 to latch the chain 4 once the desired amount of chain has been pulled through the chain support. Optionally, the latch mechanism consists of dual retainers 14 (see FIGS. 6*a* and 8*a*) mounted on opposing sides of the chain 4. Alternatively the latch mechanism includes a single retainer 21 mounted on one side of the first pair of trunnions 9 (see FIGS. 6*b*, 7*b*, and 8*b*). If there is a need to let out chain 4, a cable (not shown) can be attached to the latch mechanism to keep the latch in the open position so that the chain 4 can be lowered.

Figure 6A:
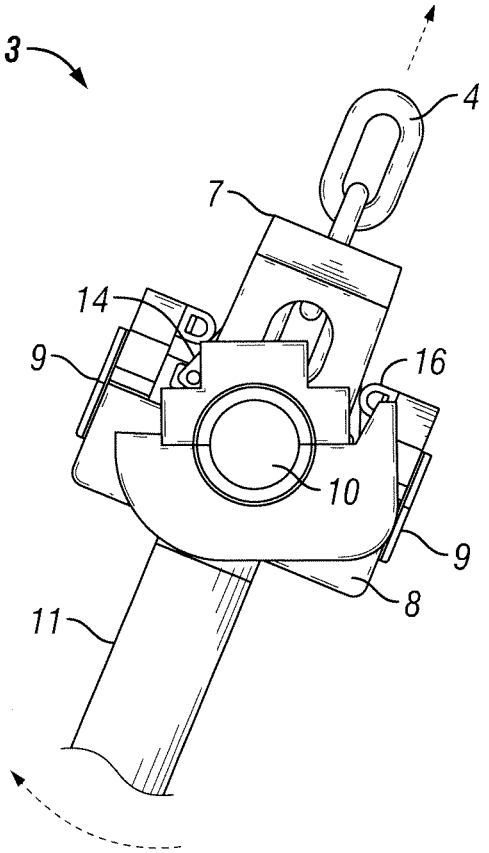
FIGS. 6*a* and 6*b* present views of the chain support view of FIG. 6*b* rotated clockwise from the views of FIG. 6*a;*
Figure 6B:
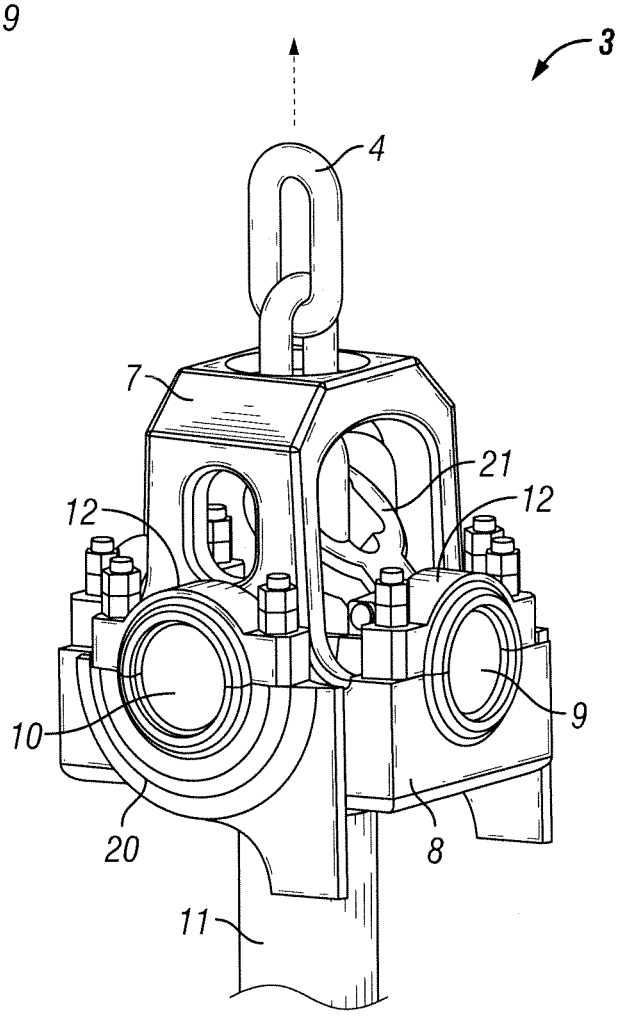

FIGS. 6*a* and 6*b* show views of the chain support 3 with the lower part of the elongated tubular member 11 removed for clarity. During operation of the chain support 3, as the mooring chain 4 is being pulled upward through the elongated tubular member 11, the orientation of the chain will change, leading to a rotation of the elongated tubular member 11 around the second pair of trunnions 10. Upper chain guide 7 guides chain 4 in a straight line through the latch mechanism, thereby preventing misalignment between the chain 4 and the latch mechanism while ensuring proper operation of the retainers 14 (FIGS. 8*a*) and 21 (FIG. 7*b*) of the latch mechanism.

Two elastomeric springs 16 (for the retainer 14 of FIG. 8*a*) are mounted on the gimbal body 8 to actuate the latch mechanism. The springs provide a passive closing system for the retainers 14 (FIGS. 6*a*, 8*a*) of the latch mechanism, regardless of the orientation of the elongated tubular member 11.

FIGS. 7*a* and 7*b* present a section view of the chain support 3 with part of the elongated tubular member 11 removed for clarity. The inside of the elongated hawse pipe 11 is fitted with a chain guide 15 consisting of grooves which, when projected onto a plane that is perpendicular to the longitudinal direction of the chain describe a cruciform. The function of the chain guide 15 is to orient alternating links of the chain parallel or perpendicular to the first pivot axis 5 (see FIGS. 5*a* and 5*b*) while the chain is being pulled through the tubular member 11 so that every other link is aligned with the latch mechanism. The latch mechanism is designed to fit around every other chain link. During operation of the chain support, the chain 4 is pulled upward through the elongated tubular member 11. The latch mechanism (14, 21) is actuated by slacking off the pull on the chain.

In the preferred embodiment, the first and second pair of trunnions 9, 10 are arranged such that the first pivot axis and the second pivot axis intersect. The arrangement can be modified to a further embodiment of the invention whereby the first and second pair of trunnions are arranged such that the first and second pivot axes do not intersect but are separated along the direction of the chain.

An item list of reference numbers used to describe the invention follows:

1 floating structure
3 chain support assembly
4 mooring chain
5 primary pivot axis
6 secondary pivot axis
7 upper chain guide
8 gimbal body
9 first pair of trunnions (on elongated tubular element)
10 second pair of trunnions (on gimbal body)
11 elongated tubular member
12 bearing caps
13 guide mouth
14 latch mechanism
15 chain guide
16 springs
17 (not used)
18. self-lubricating bushing
19. orthogonal slots in gimbal body
20. bearing block
21. single retainer

What is claimed is:

1. A chain support (3) for connecting a mooring chain (4) to a structure (1) comprising:

an elongated tubular member (11) having a passage for a mooring chain (4), said elongated tubular member (11) having an upper and a lower end;

a first pair of trunnions (9) fixedly secured to said upper end of said elongated tubular member (11);

a gimbal body (8) designed for securement to said structure (1) and having an opening to receive said elongated tubular member (11), said first pair of trunnions (9) pivotally mounted in slots of said gimbal body (8), a second pair of trunnions (10) secured to said gimbal body (8), said second pair of trunnions (10) arranged and designed for pivotal connection of said gimbal body (8) to said structure (1), said first and second pair of trunnions (9, 10) arranged to form a first pivot axis (5) and a second pivot axis (6) that are perpendicular to each other; and wherein said first and second pair of trunnions (9, 10) are positioned at the same vertical height with respect to said elongated tubular member (11) whereby said first pivot axis (5) and said second pivot axis (6) intersect each other, a latch mechanism (14, 21) for stopping and releasing said mooring chain (4), said latch mechanism (14, 21) mounted to said upper end of said elongated tubular member (11); and an upper chain guide (7) mounted to said gimbal body (8) and designed and arranged to guide said chain (4) in a direction that is perpendicular to both said first and second pivot axes (5, 6).

2. The chain support (3) of claim 1 wherein, a lower chain guide (15) is mounted inside said upper end of said tubular member (11), said lower chain guide (15) designed and arranged to orient alternating links of said mooring chain (4) parallel or perpendicular to said first pivot axis (5) while said mooring chain (4) is being pulled through said tubular member (11).

3. The chain support (3) of claim 2 wherein, said latch mechanism comprises a pair of chain retainers (14) actuated by springs (16).

4. The chain support (3) of claim 3 wherein, self-lubricating bushings (18) are placed between said trunnions (10) and said structure (1).

5. The chain support (3) of claim 2 wherein, said latch mechanism comprises a single chain retainer £21) which relies on gravity for actuation.

6. The chain support (3) of claim 1 wherein, low friction, self-lubricating bushings (18) are placed between said first pair of trunnions (9) and said gimbal body (8).

* * * * *